US010706797B2

(12) United States Patent
Hou et al.

(10) Patent No.: US 10,706,797 B2
(45) Date of Patent: Jul. 7, 2020

(54) LIQUID CRYSTAL DISPLAY, DISPLAY PANEL AND REFERENCE VOLTAGE CONTROL METHOD AND DEVICE

(71) Applicants: BOE TECHNOLOGY GROUP CO., LTD., Beijing (CN); Chongqing BOE Optoelectronics Technology Co., Ltd., Chongqing (CN)

(72) Inventors: Shuai Hou, Beijing (CN); Fei Shang, Beijing (CN); Hang Min, Beijing (CN)

(73) Assignees: BOE TECHNOLOGY GROUP CO., LTD., Beijing (CN); CHONGQING BOE OPTOELECTRONICS TECHNOLOGY CO., LTD., Chongqing (CN)

( * ) Notice: Subject to any disclaimer, the term of this patent is extended or adjusted under 35 U.S.C. 154(b) by 203 days.

(21) Appl. No.: 15/979,795

(22) Filed: May 15, 2018

(65) Prior Publication Data

US 2019/0096343 A1 Mar. 28, 2019

(30) Foreign Application Priority Data

Sep. 26, 2017 (CN) ..... 2017 1 0882230

(51) Int. Cl.
*G09G 3/36* (2006.01)

(52) U.S. Cl.
CPC ..... *G09G 3/3618* (2013.01); *G09G 3/3655* (2013.01); *G09G 3/3696* (2013.01);
(Continued)

(58) Field of Classification Search
CPC ..... G09G 2320/0247
(Continued)

(56) References Cited

U.S. PATENT DOCUMENTS

2015/0145901 A1 5/2015 Lee et al.
2018/0040286 A1* 2/2018 Huang ..... F16H 19/06

FOREIGN PATENT DOCUMENTS

CN 104376820 A 2/2015
CN 104464664 A 3/2015
(Continued)

OTHER PUBLICATIONS

First Office Action for Chinese Patent Application No. 201710882230.9 dated Jul. 2, 2019.

*Primary Examiner* — Roy P Rabindranath
(74) *Attorney, Agent, or Firm* — Calfee, Halter & Griswold LLP

(57) ABSTRACT

The present disclosure relates to a liquid crystal display, a display panel and a reference voltage control method of a display panel and a reference voltage control device for a display panel. The reference voltage control method of a display panel includes acquiring a refreshing frequency of the display panel; invoking a reference voltage database according to the refreshing frequency, to acquire reference voltage data corresponding to the refreshing frequency; generating a reference voltage adjusting signal for adjusting a reference voltage signal fixedly output by the display panel according to the reference voltage data; and synthesizing the reference voltage adjusting signal and the reference voltage signal fixedly output by the display panel to generate a reference voltage synthesis signal, and outputting the reference voltage synthesis signal to a reference voltage signal input terminal of the display panel.

14 Claims, 5 Drawing Sheets

(52) U.S. Cl.
CPC . *G09G 2310/08* (2013.01); *G09G 2320/0247* (2013.01); *G09G 2320/064* (2013.01); *G09G 2340/0435* (2013.01); *G09G 2360/145* (2013.01)

(58) Field of Classification Search
USPC ..... 345/100
See application file for complete search history.

(56) References Cited

FOREIGN PATENT DOCUMENTS

| | | | |
|---|---|---|---|
| CN | 105741814 | A | 7/2016 |
| CN | 106847226 | A | 6/2017 |
| CN | 107039013 | A | 8/2017 |

* cited by examiner

LIQUID CRYSTAL DISPLAY, DISPLAY PANEL AND REFERENCE VOLTAGE CONTROL METHOD AND DEVICE

CROSS REFERENCE

The present application claims the priority of Chinese Patent Application No. 201710882230.9, titled "LIQUID CRYSTAL DISPLAY, DISPLAY PANEL AND REFERENCE VOLTAGE CONTROL METHOD AND DEVICE", and filed on Sep. 26, 2017, and the entire contents thereof are incorporated herein by reference.

TECHNICAL FIELD

The present disclosure relates to the field of display technologies, and in particular, to a reference voltage control method of a display panel, a reference voltage control device for a display panel, a display panel, and a liquid crystal display.

BACKGROUND

When a display panel is applied to a laptop product, the refreshing frequency of the laptop product may be adjusted due to its various application occasions. For example, as for a game laptop, its refreshing frequency is required to be raised to 120 Hz or 144 Hz to improve the display effect. Meanwhile, the refreshing frequency may also be reduced to 40 Hz to reduce power consumption of the panel and prolong service life of the battery. At present, as shown in FIG. 1, the reference voltage VCOM (hereinafter referred to as VCOM voltage) output by the display panel is constant, so that the charging time and display brightness of the display panel are greatly different at different refreshing frequencies, which will directly affect the brightness of the picture. Especially, when the refreshing frequency is switched, brightness jump and screen flicker will occur, which will directly affect the use effect.

SUMMARY

An embodiment of a first aspect of the present disclosure provides a reference voltage control method of a display pane, including: acquiring a refreshing frequency of the display panel; invoking a reference voltage database according to the refreshing frequency, to acquire reference voltage data corresponding to the refreshing frequency; generating a reference voltage adjusting signal for adjusting a reference voltage signal fixedly output by the display panel according to the reference voltage data; and synthesizing the reference voltage adjusting signal and the reference voltage signal fixedly output by the display panel to generate a reference voltage synthesis signal, and outputting the reference voltage synthesis signal to a reference voltage signal input terminal of the display panel According to an embodiment of the present disclosure, the reference voltage database is built by: acquiring a refreshing frequency range of the display panel; detecting brightness and flicker value of the display panel at different refreshing frequencies in the refreshing frequency range respectively, to acquire a relationship between the refreshing frequency and the brightness and that between the refreshing frequency and the flicker value; acquiring a reference brightness and a reference flicker value range according to the relationship between the refreshing frequency and the brightness and that between the refreshing frequency and the flicker value; and adjusting reference voltage signals output by the display panel at different refreshing frequencies by inputting different reference voltage data, and obtaining reference voltage data at which the brightness of the display panel reaches the reference brightness and the flicker value of the display panel is within the reference flicker value range at each refreshing frequency, wherein the reference voltage database comprises a relationship between the refreshing frequency and the reference voltage data.

According to an embodiment of the present disclosure, the reference voltage adjusting signal is generated according to the reference voltage data by an analog-to-digital converter.

According to an embodiment of the present disclosure, the refreshing frequency range is 40 Hz~120 Hz.

According to an embodiment of the present disclosure, the reference brightness value includes one of a brightness value at an L127 gray scale and a brightness value at an L255 gray scale.

An embodiment of a second aspect of the present disclosure provides a non-transitory computer readable storage medium, in which a computer program is stored, wherein when the computer program is executed by a processor, the reference voltage control method of a display panel above is implemented.

An embodiment of a third aspect of the present disclosure provides a reference voltage control device for a display panel, including: an acquiring circuit, configured to acquire a refreshing frequency of the display panel; an invoking circuit, configured to invoke a reference voltage database according to the refreshing frequency, to acquire reference voltage data corresponding to the refreshing frequency; a generating circuit, configured to generate a reference voltage adjusting signal for adjusting a reference voltage signal fixedly output by the display panel according to the reference voltage data; and a synthesizing circuit, configured to synthesize the reference voltage adjusting signal and the reference voltage signal fixedly output by the display panel to generate a reference voltage synthesis signal, and output the reference voltage synthesis signal to a reference voltage signal input terminal of the display panel.

An embodiment of a fourth aspect of the present disclosure provides a display panel including the reference voltage control device for the display panel above.

An embodiment of a fifth aspect of the present disclosure provides a liquid crystal display including the display panel above.

DETAILED DESCRIPTION

Figure 1:
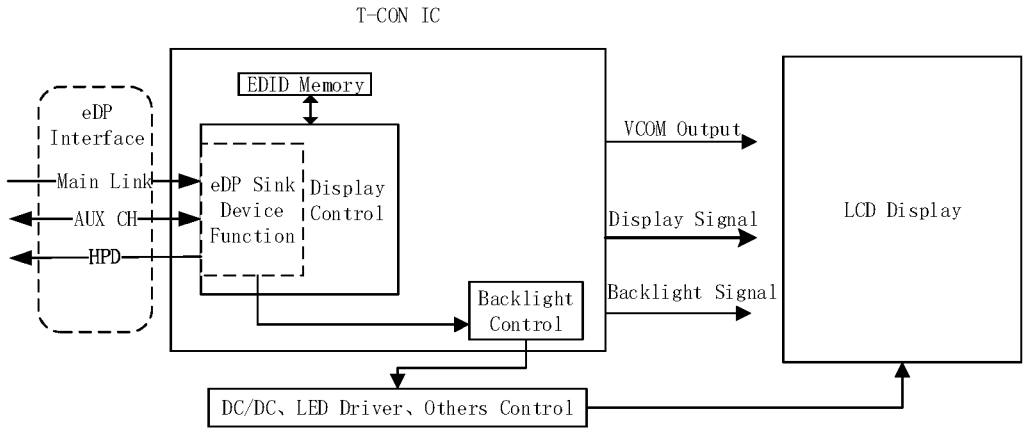
FIG. 1 is a control structure diagram of a display panel in the related art.

The embodiments of the present disclosure are described in detail below, and examples of the embodiments are shown in the drawings, wherein same or similar reference numerals denote same or similar elements or elements having the same or similar functions throughout. The embodiments described below with reference to the accompanying drawings are exemplary and are intended to explain the present disclosure but should not be construed as limiting the present disclosure.

A liquid crystal display, display panel, and method and device of controlling a reference voltage (hereinafter referred to as VCOM voltage) of the display panel according to embodiments of the present disclosure will be described below with reference to the accompanying drawings.

Figure 2:
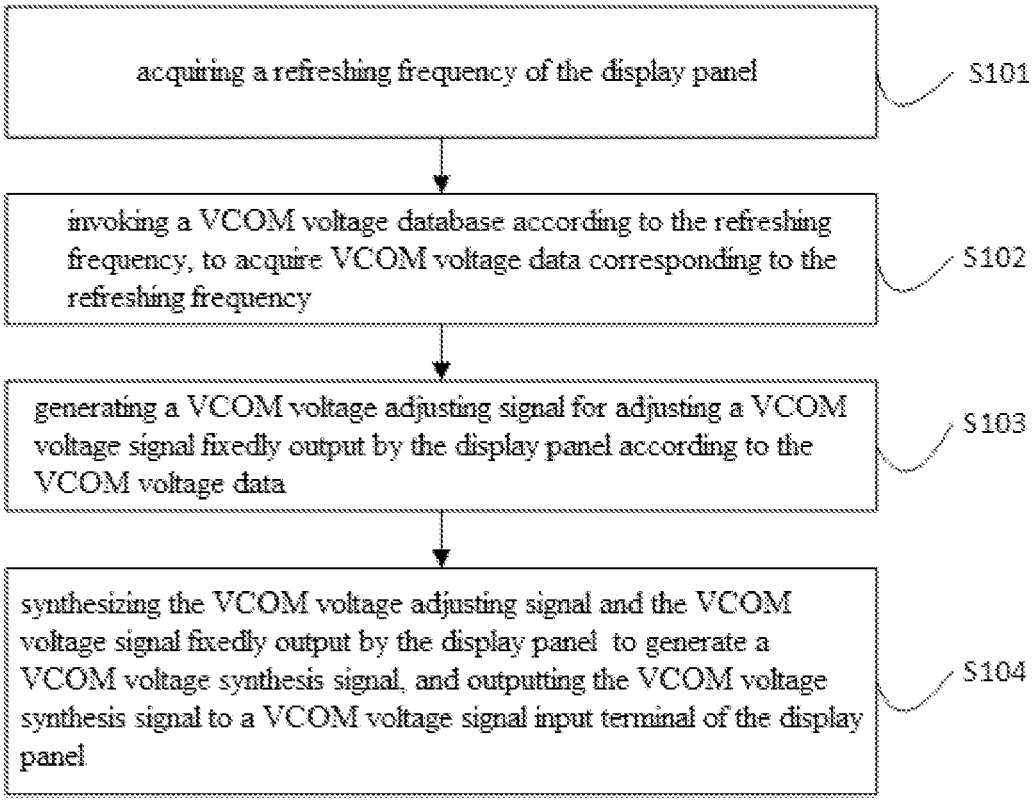
FIG. 2 is a flowchart of a method of controlling a reference voltage (hereinafter referred to as a VCOM voltage) of a display panel according to an embodiment of the present disclosure.

FIG. 2 is a flowchart of a VCOM voltage control method of a display panel according to an embodiment of the present disclosure.

As shown in FIG. 2, the VCOM voltage control method of the display panel according to an embodiment of the present disclosure includes following steps.

S101, a refreshing frequency of the display panel is acquired.

Specifically, the user may adjust the refreshing frequency of the display panel as needed. As for the display panel as shown in FIG. 1, the VCOM voltage is constant, and the adaptability of the refreshing frequency is poor. That is, the refreshing frequency should reach a certain value, for example, higher than 75 HZ, to make the human eye not easily feel the flicker.

S102, a VCOM voltage database is invoked according to the refreshing frequency, to acquire VCOM voltage data corresponding to the refreshing frequency.

Figure 3:
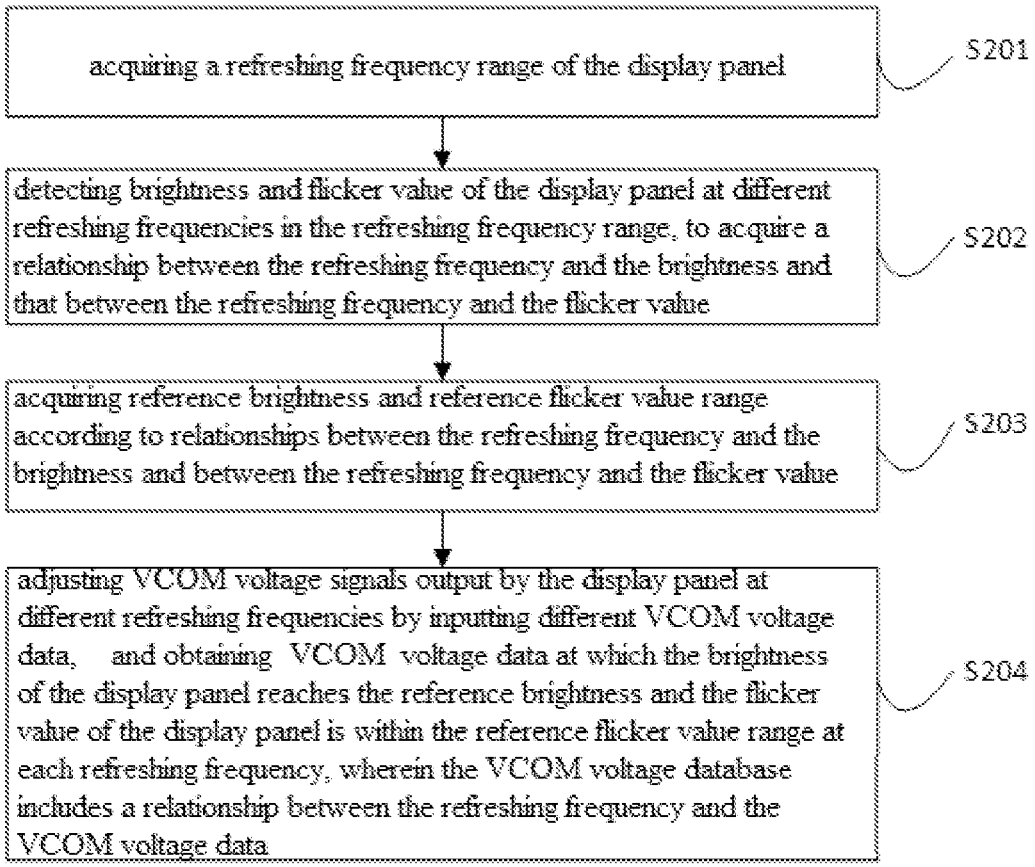
FIG. 3 is a flowchart of a method of building a VCOM voltage database according to an embodiment of the present disclosure.

In an embodiment of the present disclosure, the VCOM voltage database may be built in advance. For example, when the display panel leaves the factory, the VCOM voltage database is pre-built and stored in a laboratory by the manufacturers. Specifically, as shown in FIG. 3, the VCOM voltage database may be built by the following steps.

S201, a refreshing frequency range of the display panel is acquired.

Specifically, the refreshing frequency range may be set to be 40 Hz~120 Hz according to the application occasions of the display panel, such as a laptop. The refreshing frequency may be reduced to 40 Hz to reduce the power consumption of the display panel and prolong the service life of the laptop battery; and the refreshing frequency may be increased to 120 Hz, to improve the display effect of the display panel.

S202, brightness and flicker value of the display panel at different refreshing frequencies in the refreshing frequency range are detected respectively, to acquire a relationship between the refreshing frequency and the brightness and that between the refreshing frequency and the flicker value.

Specifically, the values within the refreshing frequency range 40 Hz~120 Hz may be sequentially taken, such as 40 Hz, 41 Hz, 42 Hz, 43 Hz, . . . , 120 Hz. When the VCOM voltage output is constant, the brightness and flicker values of the display panel at the refreshing frequencies 40 Hz, 41 Hz, 42 Hz, 43 Hz, . . . , 120 Hz are detected and recorded respectively. In the embodiment, conventional methods of detecting the brightness and flicker value in the art may be used, which will not be repeated herein.

S203, a reference brightness and a reference flicker value range are acquired according to the relationship between the refreshing frequency and the brightness and that between the refreshing frequency and the flicker value.

Specifically, after the relationship between the refreshing frequency and the brightness and that of the refreshing frequency and the flicker value are acquired, an average value, such as geometric mean value, arithmetic mean value or the like of the brightness and flicker values at different refreshing frequencies may be calculated. The brightness average value is served as the reference brightness. A range is set based on the average value of the flicker values, and for example, if the average value of the flicker values is A, the reference flicker value range is set as [A−a, A+a], wherein a may be set as required.

It should be noted that the reference brightness value may take the brightness value at an L127 gray scale or the brightness value at an L255 gray scale, to ensure that the flicker value meets visual requirements of human eyes.

S204, VCOM voltage signals output by the display panel at different refreshing frequencies are adjusted by inputting different VCOM voltage data, and VCOM voltage data at which the brightness of the display panel reaches the reference brightness and the flicker value of the display panel is within the reference flicker value range at each refreshing frequency is obtained.

In the embodiment, the VCOM voltage database includes a relationship between the refreshing frequency and the VCOM voltage data.

Specifically, different refreshing frequencies are selected from the refreshing frequency range. As for any one of the refreshing frequencies, the VCOM voltage data is input to generate a corresponding VCOM voltage adjusting signal through a built-in analog-to-digital converter. The VCOM voltage adjusting signal may be synthesized with the constant VCOM voltage signal output by the display panel, to generate the VCOM voltage synthesis signal, which is output to the VCOM voltage signal input terminal of the display panel.

Further, the VCOM voltage data is adjusted, such that the brightness of the display panel at each refreshing frequency reaches the reference brightness and the flicker value of the display panel at each refreshing frequency is within the reference flicker value range. The corresponding VCOM voltage data of the different refreshing frequencies is recorded in a table format in a register Lookup Table which is for driving a T-CON (Timing Controller) of the display panel, to form the VCOM voltage database, which facilitates the invoking of the VCOM voltage database by a table look-up manner.

S103, a VCOM voltage adjusting signal for adjusting a VCOM voltage signal fixedly output by the display panel is generated according to the VCOM voltage data.

Specifically, an analog-to-digital converter may generate the VCOM voltage adjusting signal according to the VCOM voltage data obtained by the table look-up manner.

S104, the VCOM voltage adjusting signal and the VCOM voltage signal fixedly output by the display panel are synthesized to generate a VCOM voltage synthesis signal, and the VCOM voltage synthesis signal is output to a VCOM voltage signal input terminal of the display panel, to eliminate the screen flicking phenomenon of the display panel.

Specifically, firstly, the refreshing frequency range such as 40 Hz~120 Hz of the display panel is determined. Then, the brightness and flicker values of the display panel at different refreshing frequencies are detected respectively, and then the VCOM voltage data is input to the analog-to-digital converter to adjust the VCOM voltage signals at different refreshing frequencies, to ensure that the brightness (such as the brightness at the L127 Gray level or L255 gray level) of the display panel at different refreshing frequencies are the same, and the flicker values at different refreshing frequencies reach the desired value, and the VCOM voltage data corresponding to different refreshing frequencies are recorded in the register Lookup Table of T-CON, to be served as the VCOM voltage database.

Figure 4:
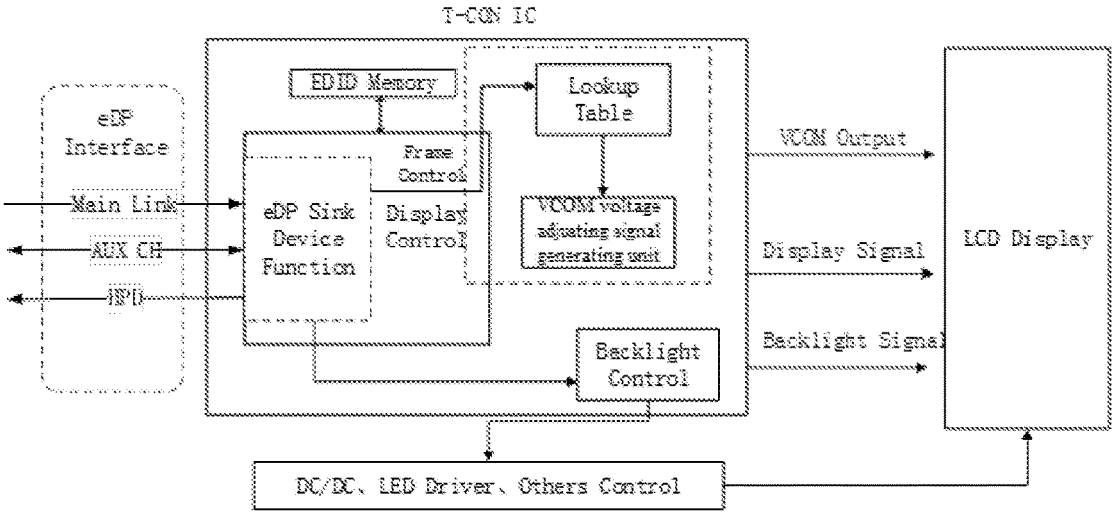
FIG. 4 is a control structure diagram of a display panel according to an embodiment of the present disclosure.
Figure 5:
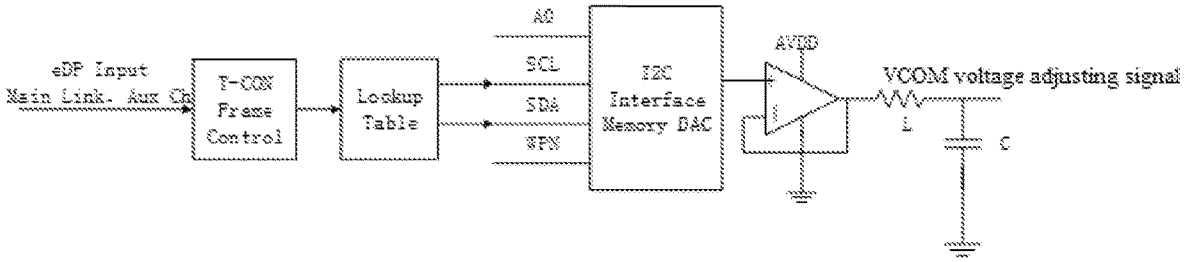
FIG. 5 is a principle schematic diagram of a VCOM voltage controlling of a display panel according to a specific embodiment of the present disclosure.

Further, referring to FIGS. 4 and 5, when the display panel is used in a computer, if the T-CON detects that the refreshing frequency output by the system is changed, the Lookup Table may be searched for acquiring the VCOM voltage data corresponding to the changed refreshing frequency. Then, the acquired VCOM voltage data is written into the analog-to-digital converter DAC via an I2C, to generate a VCOM voltage adjusting signal. The VCOM voltage adjusting signal may be superimposed with the constant VCOM voltage signal output by the display panel, to generate the VCOM voltage synthesis signal, which is output to the VCOM voltage signal input terminal of the display panel. Therefore, the brightness and the flicker value of the display panel may be the same as the brightness and the flicker value before the refreshing frequency is switched, and the screen flicking phenomenon may be eliminated.

To sum up, according to the VCOM voltage control method of the display panel of the embodiment of the present disclosure, the refreshing frequency of the display panel is acquired firstly, and the VCOM voltage database is invoked according to the refreshing frequency to acquire the VCOM voltage data corresponding to the refreshing frequency. Then, the VCOM voltage adjusting signal for adjusting the VCOM voltage signal fixedly output by the display panel is generated according to the VCOM voltage data. Then, the VCOM voltage adjusting signal and the VCOM voltage signal fixedly output by the display panel are synthesized to generate the VCOM voltage synthesis signal, and the VCOM voltage synthesis signal is output to the VCOM voltage signal input terminal of the display panel, to eliminate the screen flicking phenomenon of the display panel. Thereby, it is possible to eliminate the screen flicking phenomenon of the display panel and improve the user experience.

Further, the present disclosure provides a non-transitory computer readable storage medium, having a computer program stored thereon, wherein when the computer program is executed by a processor, the VCOM voltage control method of a display panel described above is implemented.

In the non-transitory computer readable storage medium in this embodiment of the present disclosure, by executing the program stored thereon which corresponds to the VCOM voltage control method of the display panel, the screen flicking phenomenon of the display panel may be eliminated and the user experience may be improved.

Figure 6:
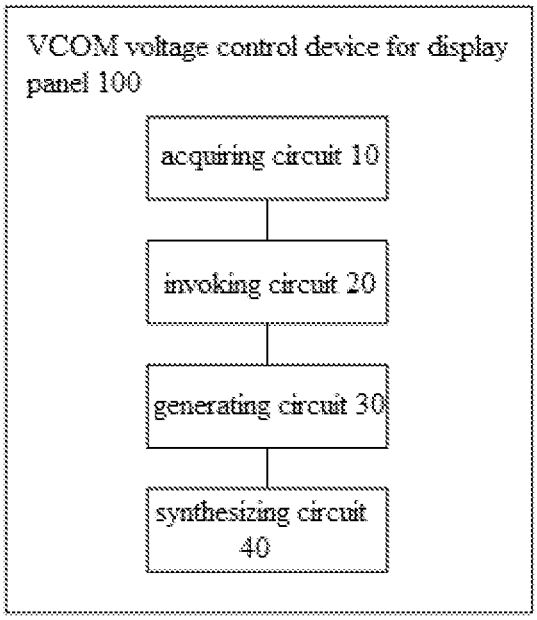
FIG. 6 is a block diagram of a VCOM voltage control device of a display panel according to an embodiment of the present disclosure.

FIG. 6 is a block diagram of a VCOM voltage control device of a display panel according to an embodiment of the present disclosure. As shown in FIG. 6, the VCOM voltage control device 100 for the display panel includes: an acquiring circuit 10, an invoking circuit 20, a generating circuit 30 and a synthesizing circuit 40.

In an embodiment, the acquiring circuit 10 is configured to acquire a refreshing frequency of the display panel. The invoking circuit 20 is configured to invoke a VCOM voltage database according to the refreshing frequency, to acquire VCOM voltage data corresponding to the refreshing frequency. The generating circuit 30 is configured to generate a VCOM voltage adjusting signal for adjusting a VCOM voltage signal fixedly output by the display panel according to the VCOM voltage data. The synthesizing circuit 40 is configured to synthesize the VCOM voltage adjusting signal and the VCOM voltage signal fixedly output by the display panel to generate a VCOM voltage synthesis signal, and output the VCOM voltage synthesis signal to a VCOM voltage signal input terminal of the display panel, to eliminate the screen flicking phenomenon of the display panel.

In an embodiment of the present disclosure, the VCOM voltage database may be built in advance. For example, when the display panel leaves the factory, the VCOM voltage database is pre-built and stored in a laboratory by the manufacturers. Specifically, as shown in FIG. 3, the VCOM voltage database may be built by the following steps.

S201, a refreshing frequency range of the display panel is acquired.

Specifically, the refreshing frequency range may be set to be 40 Hz~120 Hz according to the application occasions of the display panel, such as a laptop. The refreshing frequency may be reduced to 40 Hz to reduce the power consumption of the display panel and prolong the service life of the laptop battery; and the refreshing frequency may be increased to 120 Hz, to improve the display effect of the display panel.

S202, brightness and flicker value of the display panel at different refreshing frequencies in the refreshing frequency range are detected respectively, to acquire a relationship between the refreshing frequency and the brightness and that between the refreshing frequency and the flicker value.

Specifically, the values within the refreshing frequency range 40 Hz~120 Hz may be sequentially taken, such as 40 Hz, 41 Hz, 42 Hz, 43 Hz, . . . , 120 Hz. When the VCOM voltage output is constant, the brightness and flicker values of the display panel at the refreshing frequencies 40 Hz, 41 Hz, 42 Hz, 43 Hz, . . . , 120 Hz are detected and recorded respectively. In the embodiment, conventional methods of detecting the brightness and flicker value in the art may be used, which will not be repeated herein.

S203, a reference brightness and a reference flicker value range are acquired according to the relationship between the refreshing frequency and the brightness and that between the refreshing frequency and the flicker value.

Specifically, after the relationship between the refreshing frequency and the brightness and that of the refreshing frequency and the flicker value are acquired, an average value, such as geometric mean value, arithmetic mean value or the like of the brightness and flicker values at different refreshing frequencies may be calculated. The brightness average value is served as the reference brightness. A range is set based on the average value of the flicker values, and for example, if the average value of the flicker values is A, the reference flicker value range is set as [A-a, A+a], wherein a may be set as required.

It should be noted that the reference brightness value may take the brightness value at an L127 gray scale or the brightness value at an L255 gray scale, to ensure that the flicker value meets visual requirements of human eyes.

S204, VCOM voltage signals output by the display panel at different refreshing frequencies are adjusted by inputting different VCOM voltage data, and VCOM voltage data at which the brightness of the display panel reaches the reference brightness and the flicker value of the display panel is within the reference flicker value range at each refreshing frequency is obtained.

In the embodiment, the VCOM voltage database includes a relationship between the refreshing frequency and the VCOM voltage data.

Specifically, different refreshing frequencies are selected from the refreshing frequency range. As for any one of the refreshing frequencies, the VCOM voltage data is input to generate a corresponding VCOM voltage adjusting signal through a built-in analog-to-digital converter. The VCOM voltage adjusting signal may be synthesized with the constant VCOM voltage signal output by the display panel, to generate the VCOM voltage synthesis signal, which is output to the VCOM voltage signal input terminal of the display panel.

Further, the VCOM voltage data is adjusted, such that the brightness of the display panel at each refreshing frequency reaches the reference brightness and the flicker value of the display panel at each refreshing frequency is within the reference flicker value range. The corresponding VCOM voltage data of the different refreshing frequencies is recorded in a table format in a register Lookup Table which is for driving a T-CON (Timing Controller) of the display panel, to form the VCOM voltage database, which facilitates the invoking of the VCOM voltage database by a table look-up manner.

Figure 7:
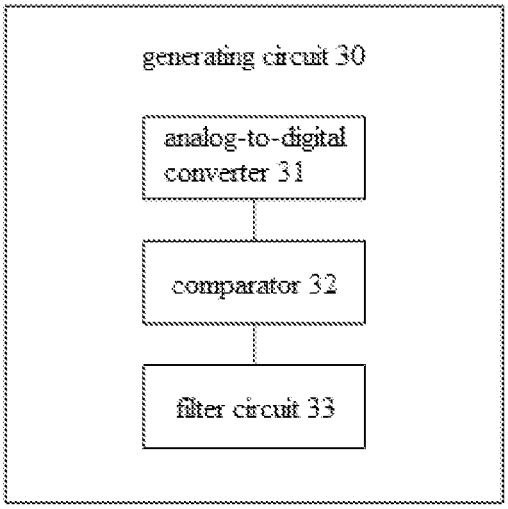
FIG. 7 is a block diagram of a generating circuit according to a specific embodiment of the present disclosure.

In an embodiment of the present disclosure, as shown in FIG. 7, the generating circuit 30 may further include: an analog-to-digital converter 31, a comparator 32 and a filter circuit 33.

In an embodiment, an input terminal of the analog-to-digital converter 31 is connected to an output terminal of the invoking circuit 20. A positive input terminal of the comparator 32 is connected to an output terminal of the analog-to-digital converter 31, and an output terminal of the comparator 32 is connected to a negative input terminal of the comparator 32. A first terminal of the filter circuit 33 is connected to the output terminal of the comparator 32, a second terminal of the filter circuit 33 is grounded, and an output terminal of the filter circuit 33 outputs the VCOM voltage adjusting signal.

In an embodiment, as shown in FIG. 5, the filter circuit 33 includes an inductor L and a capacitor C. One terminal of the inductor L is connected to the output terminal of the comparator 32, and the other terminal of the inductor L is used as the output terminal of the VCOM voltage adjusting signal. One terminal of the capacitor C is grounded, and the other terminal of the capacitor C is connected to the other terminal of the inductor L. Thus, the signal output by the analog-to-digital converter 31 and the comparator 32 may be filtered by the inductor L and the capacitor C and then output.

Specifically, firstly, the VCOM voltage database is built by the method as shown in FIG. 3. Then, referring to FIGS. 4 and 5, when the display panel is used in a computer, if the T-CON detects that the refreshing frequency output by the system is changed, the acquiring circuit 10 acquires the changed refreshing frequency, and the invoking circuit 20 may search the Lookup Table to acquire the VCOM voltage data corresponding to the refreshing frequency. Then, the acquired VCOM voltage data is written into the analog-to-digital converter DAC via an I2C, to generate a VCOM voltage adjusting signal through the generating circuit 30. The synthesizing circuit 40 superimposes the VCOM voltage adjusting signal with the constant VCOM voltage signal output by the display panel, to generate the VCOM voltage synthesis signal, which is output to the VCOM voltage signal input terminal of the display panel. Therefore, the brightness and the flicker value of the display panel may be the same as the brightness and the flicker value before the refreshing frequency is switched, and the screen flicking phenomenon may be eliminated.

It should be noted that, other specific implementations of the VCOM voltage control device for the display panel of the embodiments of the present disclosure may be referred to the specific implementations of the VCOM voltage control method of the display panel in the above embodiments of the present disclosure.

To sum up, according to the VCOM voltage control device for the display panel in the embodiment of the present disclosure, the acquiring circuit acquires the refreshing frequency of the display panel, and the invoking circuit invokes the VCOM voltage database according to the refreshing frequency to acquire the VCOM voltage data corresponding to the refreshing frequency. Then, the generating circuit generates the VCOM voltage adjusting signal for adjusting the VCOM voltage signal fixedly output by the display panel according to the VCOM voltage data. Then, the synthesizing circuit synthesizes the VCOM voltage adjusting signal and the VCOM voltage signal fixedly output by the display panel to generate the VCOM voltage synthesis signal, and outputs the VCOM voltage synthesis signal to the VCOM voltage signal input terminal of the display panel, to eliminate the screen flicking phenomenon of the display panel. Thereby, it is possible to eliminate the screen flicking phenomenon of the display panel and improve the user experience.

Figure 8:
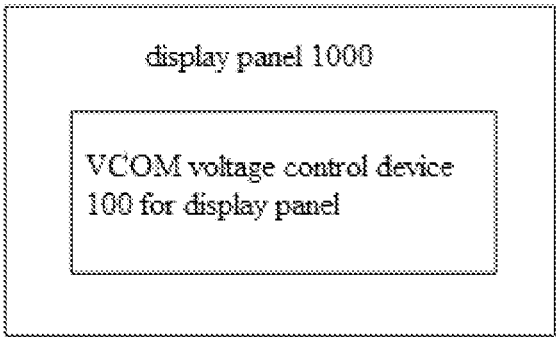
FIG. 8 is a block diagram of a display panel according to an embodiment of the present disclosure.

FIG. 8 is a block diagram of a display panel according to an embodiment of the present disclosure.

As shown in FIG. 8, the display panel 1000 includes the VCOM voltage control device 100 for the display panel in the above embodiment.

The display panel of the embodiment of the present disclosure adopts the above VCOM voltage control device for the display panel, which may eliminate the screen flicking phenomenon of the display panel and improve the user experience.

Figure 9:
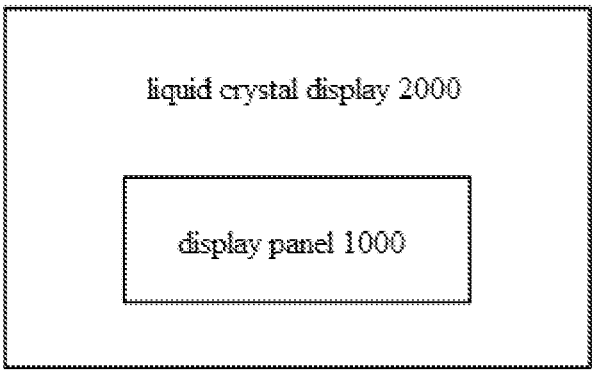
FIG. 9 is a block diagram of a liquid crystal display according to an embodiment of the present disclosure.

FIG. 9 is a block diagram of a liquid crystal display according to an embodiment of the present disclosure.

As shown in FIG. 9, the liquid crystal display includes the display panel of the above embodiment.

The liquid crystal display according to the embodiment of the present disclosure adopts the above display panel, which may eliminate the screen flicking phenomenon of the display panel and improve the user experience.

In addition, other compositions and functions of the liquid crystal display according to the embodiments of the present disclosure are known to those skilled in the art. To avoid redundancy, details are not described herein.

In the description of the specification, the description of reference terms "one embodiment", "some embodiments", "an example", "a specific example", or "some examples" and the like means the specific features, structures, materials, or characteristics described in connection with the embodiment or example are included in at least one embodiment or example of the present disclosure. In the present specification, a schematic expression of the above terms does not necessarily direct at the same embodiment or example. Furthermore, the particular features, structures, materials, or characteristics described may be combined in any suitable manner in any one or more of the embodiments or examples. In addition, different embodiments or examples described in this specification and features of different embodiments or examples may be combined and incorporated by those skilled in the art without mutual contradiction.

In addition, terms "first" and "second" are used for descriptive purposes only but not to be construed as indicating or implying relative importance or implicitly indicating the number of indicated technical features. Thus, features defining with "first" and "second" may explicitly or implicitly include at least one of the features. In the description of the present disclosure, "a plurality of" means at least two, for example, two, three, etc., unless defined explicitly and concretely otherwise.

Any process or method descriptions described in flowcharts or otherwise herein may be understood as representing modules, segments or portions that include codes of one or more executable instructions for implementing steps of a custom logic function or process. The scope of preferred embodiments of the present disclosure includes additional implementations in which functions may not be performed in the order shown or discussed, including the substantially simultaneous or reverse order according to the involved functions, which should be understood by those skilled in the art to which the embodiments of the present disclosure belong.

Logic and/or steps, which are represented in the flowcharts or otherwise described herein, for example, may be considered as a sequencing listing of executable instructions for implementing logic functions, which may be concretely embodied in any computer readable medium, for use by or in connection with an instruction execution system, device, or apparatus (such as a computer-based system, a processor-included system, or other systems that may fetch instructions from an instruction execution system, device, or apparatus and execute the instructions). For the purposes of this specification, a "computer readable medium" may be any device that may contain, store, communicate, propagate, or transport the program for use by or in connection with the instruction execution system, device, or apparatus. More specific examples (a non-exhaustive list) of computer readable media include the following: an electrical connection portion (electronic device) having one or more wires, a portable computer disk cartridge (magnetic device), a random access memory (RAM), a read only memory (ROM), an erasable programmable read only memory (EPROM or flash memory), an optical fiber device, and a compact disc read only memory (CDROM). In addition, the computer readable medium may even be the paper or other suitable medium upon which the program may be printed, since the program may be obtained, for example, by optical scanning the paper or other medium, followed by editing, interpretation or other suitable manners when necessary, and then stored in a computer memory.

It should be understood that, portions of the present disclosure may be implemented in hardware, software, firmware, or a combination thereof. In the above embodiments, multiple steps or methods may be implemented by software or firmware which is stored in memory and executed by a suitable instruction execution system. If the implementation in hardware is the same as in another embodiment, it may be implemented by using any one of the following techniques well known in the art or a combination thereof: discrete logic circuits having logic gate circuits for implementing logic functions of data signals, application specific integrated circuits having suitable combinational logic gate circuits, programmable gate arrays (PGAs), field programmable gate arrays (FPGAs), and the like.

A person of ordinary skill in the art may understand that all or part of the steps carried in the methods in the foregoing embodiments may be implemented by a program instructing relevant hardware. The program may be stored in a computer readable storage medium, when executed, one of the steps of the method embodiment or a combination thereof is included.

In addition, each of the functional units in the embodiments of the present disclosure may be integrated in one processing module, or each of the units may physically exist separately, or two or more units may be integrated in one module. The above-mentioned integrated module may be implemented in the form of hardware or in the form of software functional module. When the integrated module is implemented in the form of a software function module and is sold or used as an independent product, the integrated module may also be stored in a computer readable storage medium.

The above-mentioned storage medium may be a read only memory, a magnetic disk, an optical disk, or the like. Although the embodiments of the disclosure have been shown and described above, it should be understood that the above embodiments are merely exemplary and should not be construed as limiting the present disclosure. Those skilled in the art may change, modify, replace, and vary the above embodiments within the scope of the present disclosure.

In the description of the present disclosure, it should be understood that the orientation or positional relationships indicated by terms "center", "longitudinal", "transverse", "length", "width", "thickness", "upper", "lower", "front", "back", "left", "right", "vertical", "horizontal", "top", "bottom", "inner", "outer", "clockwise", "counterclockwise", "axial", "radial", "circumferential" and the like are based on the orientation or positional relationships shown in the drawings, merely for facilitating the description of the present disclosure and simplifying the description, but not to indicate or imply that the referred device or element must have a particular orientation, being constructed and operated in a particular orientation, and therefore should not be construed as limiting the present disclosure.

In the present disclosure, the terms "mounting", "connecting", "connect", "fixing" and the like should be broadly understood unless expressly stated and limited otherwise. For example, it may be fixed connection or detachable connection, or integrated into one; it may be a mechanical connection, or also be an electrical connection; it may be directly connected, or may also be indirectly connected through an intermediate, it may be communication inside two elements or the interaction between the two elements. For those skilled in the art, the specific meanings of the above terms in the present disclosure may be understood according to specific situations.

In the present disclosure, unless expressly stated and limited otherwise, the first feature being "on" or "below" the second feature may be either the first and second features are in direct contact or the first and second features may be indirectly contacted through an intermediate. Furthermore, the first feature being "on", "above" and "over" the second feature may be either the first feature is right above or obliquely above the second feature or merely indicates that the level height of the first feature is higher than that of the second feature. The first feature being "below", "under" and "underneath" the second feature may be either the first feature is right below or obliquely below the second feature or merely indicates that the level height of the first feature is lower than that of the second feature.

Although the embodiments of the present disclosure have been shown and described above, it should be understood that the above embodiments are merely exemplary and should not be construed as limiting the present disclosure.

Those skilled in the art may change, modify, replace, and vary the above embodiments within the scope of the present disclosure.

What is claimed is:

1. A reference voltage control method of a display panel, comprising:

acquiring a refreshing frequency of the display panel;

invoking a reference voltage database according to the refreshing frequency, to acquire reference voltage data corresponding to the refreshing frequency;

generating a reference voltage adjusting signal for adjusting a reference voltage signal fixedly output by the display panel according to the reference voltage data; and synthesizing the reference voltage adjusting signal and the reference voltage signal fixedly output by the display panel to generate a reference voltage synthesis signal, and outputting the reference voltage synthesis signal to a reference voltage signal input terminal of the display panel, wherein the reference voltage database is built by:

acquiring a refreshing frequency range of the display panel;

detecting brightness and flicker value of the display panel at different refreshing frequencies in the refreshing frequency range respectively, to acquire a relationship between the refreshing frequency and the brightness and that between the refreshing frequency and the flicker value;

acquiring a reference brightness and a reference flicker value range according to the relationship between the refreshing frequency and the brightness and that between the refreshing frequency and the flicker value; and adjusting reference voltage signals output by the display panel at different refreshing frequencies by inputting different reference voltage data, and obtaining reference voltage data at which the brightness of the display panel reaches the reference brightness and the flicker value of the display panel is within the reference flicker value range at each refreshing frequency, wherein the reference voltage database comprises a relationship between the refreshing frequency and the reference voltage data.

2. The reference voltage control method of a display panel according to claim 1, wherein the reference voltage adjusting signal is generated according to the reference voltage data by an analog-to-digital converter.

3. The reference voltage control method of a display panel according to claim 1, wherein the refreshing frequency range is 40 Hz~120 Hz.

4. The reference voltage control method of a display panel according to claim 1, wherein the reference brightness value comprises one of a brightness value at an L127 gray scale and a brightness value at an L255 gray scale.

5. A non-transitory computer readable storage medium, in which a computer program is stored, wherein when the computer program is executed by a processor, the reference voltage control method of a display panel according to claim 1 is implemented.

6. A reference voltage control device for a display panel, comprising:

an acquiring circuit, configured to acquire a refreshing frequency of the display panel;

an invoking circuit, configured to invoke a reference voltage database according to the refreshing frequency, to acquire reference voltage data corresponding to the refreshing frequency;

a generating circuit, configured to generate a reference voltage adjusting signal for adjusting a reference voltage signal fixedly output by the display panel according to the reference voltage data; and a synthesizing circuit, configured to synthesize the reference voltage adjusting signal and the reference voltage signal fixedly output by the display panel to generate a reference voltage synthesis signal, and output the reference voltage synthesis signal to a reference voltage signal input terminal of the display panel.

7. The reference voltage control device for a display panel according to claim 6, wherein the generating circuit comprises:

an analog-to-digital converter, having an input terminal connected to an output terminal of the invoking circuit;

a comparator, having a positive input terminal connected to an output terminal of the analog-to-digital converter, and an output terminal connected to a negative input terminal of the comparator; and a filter circuit, having a first terminal connected to the output terminal of the comparator, a second terminal being grounded, and an output terminal outputting the reference voltage adjusting signal.

8. The reference voltage control device for a display panel according to claim 6, wherein the refreshing frequency range is 40 Hz~120 Hz.

9. The reference voltage control device for a display panel according to claim 6, wherein the reference brightness value comprises one of a brightness value at an L127 gray scale and a brightness value at an L255 gray scale.

10. A display panel, comprising a reference voltage control device comprising:

an acquiring circuit, configured to acquire a refreshing frequency of the display panel;

an invoking circuit, configured to invoke a reference voltage database according to the refreshing frequency, to acquire reference voltage data corresponding to the refreshing frequency;

a generating circuit, configured to generate a reference voltage adjusting signal for adjusting a reference voltage signal fixedly output by the display panel according to the reference voltage data; and a synthesizing circuit, configured to synthesize the reference voltage adjusting signal and the reference voltage signal fixedly output by the display panel to generate a reference voltage synthesis signal, and output the reference voltage synthesis signal to a reference voltage signal input terminal of the display panel.

11. The display panel according to claim 10, wherein the generating circuit comprises:

an analog-to-digital converter, having an input terminal connected to an output terminal of the invoking circuit;

a comparator, having a positive input terminal connected to an output terminal of the analog-to-digital converter, and an output terminal connected to a negative input terminal of the comparator; and a filter circuit, having a first terminal connected to the output terminal of the comparator, a second terminal being grounded, and an output terminal outputting the reference voltage adjusting signal.

12. The display panel according to claim 10, wherein the refreshing frequency range is 40 Hz~120 Hz.

13. The display panel according to claim 10, wherein the reference brightness value comprises one of a brightness value at an L127 gray scale and a brightness value at an L255 gray scale.

14. A liquid crystal display, comprising the display panel according to claim 10.

* * * * *